US006824088B2

(12) United States Patent
Robinson

(10) Patent No.: US 6,824,088 B2
(45) Date of Patent: Nov. 30, 2004

(54) ROLLER MILL

(75) Inventor: Ian Robinson, Pen Argyl, PA (US)

(73) Assignee: Foster Wheeler Energy Corporation, Clinton, NJ (US)

( * ) Notice: Subject to any disclaimer, the term of this patent is extended or adjusted under 35 U.S.C. 154(b) by 332 days.

(21) Appl. No.: 09/848,279

(22) Filed: May 4, 2001

(65) Prior Publication Data

US 2002/0162909 A1 Nov. 7, 2002

(51) Int. Cl.[7] ..... B02C 15/00
(52) U.S. Cl. ..... 241/121; 241/293
(58) Field of Search ..... 241/117–121, 293

(56) References Cited

U.S. PATENT DOCUMENTS

| | | | |
|---|---|---|---|
| 3,366,338 | A | 1/1968 | Barton |
| 4,234,132 | A | 11/1980 | Maliszewski |
| 4,606,506 | A | 8/1986 | Okada et al. |
| 4,611,765 | A | 9/1986 | Shimojima et al. |
| 4,643,366 | A | 2/1987 | Soma et al. |
| 4,679,739 | A | 7/1987 | Hashimoto et al. |
| 5,518,192 | A | 5/1996 | Hamaguchi |
| 5,597,124 | A | 1/1997 | Kessel et al. |

FOREIGN PATENT DOCUMENTS

| | | |
|---|---|---|
| DE | 195 03 179 | 8/1996 |
| JP | 60-12150 | 1/1985 |
| JP | 1-236953 | 9/1989 |
| JP | 2-26647 | 1/1990 |
| JP | 4-243551 | 8/1992 |
| JP | 5-104010 | 4/1993 |
| JP | 7-222933 | 8/1995 |
| JP | 7-275728 | 10/1995 |
| JP | 10-99701 | 4/1998 |
| JP | 2000-140663 | 5/2000 |

OTHER PUBLICATIONS

International Search Report dated Jul. 28, 2002, issued in corresponding international patent appln. No. PCT/IB 02/01438.

*Primary Examiner*—Mark Rosenbaum
(74) *Attorney, Agent, or Firm*—Fitzpatrick, Cella, Harper & Scinto

(57) ABSTRACT

A roller mill includes a base, a pulverizing table having a substantially horizontal upper surface, supported against the base and arranged to rotate around a vertical axis intersecting the upper surface in a center point thereof, an annular groove, formed on the upper surface of the pulverizing table, adjacent to an outer periphery of the table, at least one roller shaft mounted pivotally on the base in proximity to the table, at an angle α with respect to a horizontal direction, toward the center point and having an end portion located above the table, a pulverizing roller supported rotatably against the end portion of the at least one roller shaft and a device for pressing the pulverizing roller toward the annular groove. An outer peripheral surface of the pulverizing roller has a smooth, generally arcuate cross section with at least one substantially flat section in the central portion thereof.

13 Claims, 2 Drawing Sheets

ROLLER MILL

BACKGROUND OF THE INVENTION

The present invention relates to improvements in a vertical roller mill. More particularly, this invention relates to a roller mill having a high pulverizing efficiency due to optimized mating of pulverizing surfaces of the roller mill.

In a roller mill, hard raw material, such as coal, is fed between pulverizing rollers and a substantially horizontal upper surface of a pulverizing table, which rotates around a vertical axis. The raw material is pulverized by compression between the pulverizing table and the rotatable pulverizing rollers. In one type of conventional roller mills, shown, e.g., in U.S. Pat. No. 4,234,132, the cross-sectional shapes of the pulverizing surfaces, i.e., the upper surface of the pulverizing table and the peripheral surface of the rollers, are flat. In another type of conventional roller mills, shown, e.g., in U.S. Pat. No. 3,366,338, the peripheral cross-sectional shape of the rollers is arcuate, and an annular groove having an approximately similar arcuate cross-sectional profile is provided in the pulverizing table.

When raw material is pulverized in a gap formed between the pulverizing table and the rotatable rollers, the shape of the individual pulverizing components affects the pulverizing efficiency and the general performance characteristics, such as the level of vibrations or power consumption, of the mill. Therefore, a variety of different modifications of the above-mentioned cross-sectional profiles of the pulverizing surfaces has been suggested.

U.S. Pat. No. 4,606,506 discloses a roller mill with arcuate pulverizing surfaces arranged radially on the outer side of the system and flat pulverizing surface cross sections, i.e., conical surfaces, on the inner side thereof. The purpose of this construction is to induce uniform wear of the rollers by avoiding high wear of the coarse grinding, i.e., the inner side of the system. Japanese Patent Publication No. 2026647A2 discloses a roller type crushing apparatus which provides improved crushing efficiency by arranging the crushing surfaces of the rollers and of the rotating table to have almost similar contours consisting of two circular arcs with different radii of curvature.

U.S. Pat. No. 4,611,765 shows a roller mill with at least one annular recess on the pulverizing surface of the pulverizing rollers. The system is also characterized by the gap between the pulverizing roller and the pulverizing table having a wedge-like sectional shape tapering towards the outer side of the pulverizing table. The narrow gap prevents the material from escaping too early from the pulverizing area.

Due to non-uniform wear of the pulverizing surfaces, their outer portions may protrude relative to the areas located closer to the center of the pulverizing table. U.S. Pat. No. 5,518,192 suggests a roller mill in which the outer portion of the pulverizing surface in a pulverizing roller is chamfered in order to avoid the formation of protruding areas and to ensure smooth discharge of the pulverized product to the outside of the pulverizing table.

The above-described modifications of the pulverizing surface profiles generally eliminate some of the deficiencies in most conventional roller mills, but the need for simple pulverizing surfaces with improved overall performance of the system still exists.

SUMMARY OF THE INVENTION

The object of the present invention is to provide a roller mill having simple pulverizing surfaces and which provides high performance.

More particularly, the object of the present invention is to provide a roller mill having pulverizing surfaces at a rotating pulverizing table and at rotatable rollers ensuring efficient pulverization.

Another object of the present invention is to provide a roller mill having pulverizing surfaces at a rotating pulverizing table and at rotatable rollers ensuring economical and reliable operation of the roller mill.

In order to achieve these and other objects of the present invention, a roller mill is provided, comprising: a base; a pulverizing table having a substantially horizontal upper surface supported against the base and arranged to be rotated around a vertical axis intersecting the upper surface of the pulverizing table in a center point thereof; an annular groove formed in the upper surface of the pulverizing table, adjacent to an outer periphery of the table; at least one roller shaft mounted pivotally on the base in proximity to the table at an angle $\alpha$ with respect to a horizontal direction toward the center point and having an end portion located above the table; a pulverizing roller supported rotatably against the end portion of the at least one roller shaft; and means for pressing the pulverizing roller toward the annular groove, wherein raw material introduced to the rotatable pulverizing table is pulverized by compression between the annular groove and the at least one pulverizing roller, and wherein an outer peripheral surface of the pulverizing roller has a smooth, generally arcuate cross section with at least one substantially flat section in the central portion thereof.

It is generally known that conventional concentric circular pulverizing surface profiles are subject to non-uniform wear of their surfaces. The present invention is based on the surprising observation that the above-mentioned features of pulverizing surfaces are especially advantageous in a pulverizing surface profile. The general idea of the present roller mill design is to arrange a large portion of the grinding surfaces in contact with each other under a typically applied load. This is achieved by well-matching the pulverizing surface profiles as much as possible. Additionally, it has been found that certain, apparently minor, details of the pulverizing surfaces can be optimized to improve the efficiency and durability of the roller mill.

I have discovered that the width of the substantially flat section in the central portion of the peripheral surface of the roller should make up a suitable portion of the peripheral surface. The width of the flat section is preferably between about 20% and about 60%, more preferably between about 25% and about 40%, of the axial thickness of the roller, mainly depending on the characteristics of the material to be pulverized. By way of example, when coal is pulverized, the width being 30% of the axial thickness of the roller has proved to be suitable.

The flat section is to be located near the central plane of the roller, i.e., near the plane perpendicular to the roller axis at an equal distance from its inner and outer axial faces. However, according to a preferred embodiment of the present invention, the flat section is located closer to the inner axial face of the roller, i.e., the face which is toward the center of the pulverizing table, than to the outer axial face. Thus, according to the preferred embodiment, the substantially flat section extends for a distance $W_1$ from the central plane of the roller toward the center of the pulverizing plate and for a distance $W_2$ therefrom toward the outer edge of the pulverizing plate, whereby $W_1$ is larger than $W_2$.

A flat section in a generally circular contour forms a chord of the circle, and shifting this chord of constant length results necessarily in changing its direction.

Correspondingly, according to a preferred embodiment of the present invention, the flat section is not parallel to the axis of the roller, but somewhat more horizontal. Usually, the axis of the roller is slanted at an angle $\alpha$, typically about 15°, toward the center of the pulverizing table. The direction of the flat section is preferably closer to the horizontal direction than the axis of the roller. Preferably, the flat section forms an angle $\beta$ with the direction of the roller axis, $\beta$ being between 0° and $\alpha$, preferably between about 2° and about 6°, most preferably about 4°.

The advantageousness of the above-described preferred direction of the flat section is based on the resulting optimized shape of the gap formed between the pulverizing surfaces. The radial flow of pulverized material slows down in the widened central portion of the gap, and thus, there is enough time for thorough grinding of the material. No noticeable recess is, however, formed in the central part of the peripheral surface of the roller, and thus, the load is distributed evenly over the entire surface thus, contributing to the grinding. Moreover, due to the smoothness of the pulverizing surfaces, the movement of the material is stable, and the surfaces are not prone to irregular wear or breakage. A correct angle of the flat section is also important for providing a stable flow of material through the gap.

The annular groove in the outer edge portion of the top surface of the pulverizing table has a generally arcuate cross-sectional profile. The profiles of the groove and roller define the shape of the gap between the pulverizing surfaces. According to a preferred embodiment of the present invention, the cross-sectional profile of the groove has a first radius of curvature in the radially inner portion of the groove and a second radius of curvature in the radially outer portion of the groove, the first radius of curvature being smaller than the second radius of curvature.

The groove with the above-mentioned profile and the roller profile provided with a flat section, together define a gap which has a minimum height in the radially inner portion thereof and another, local minimum height in the radially outer portion thereof. This shape has proved to be especially advantageous for efficient grinding and low and uniform wearing of the surfaces. The outer minimum height of the gap is preferably only slightly smaller than its maximum height in the central portion of the gap. The narrowest point at which the height of the gap is typically at most about 50% of its maximum is preferably in the inner portion.

Due to the contour of the present roller, it will ride over the material in the annular groove rather than being forced to plow through the total depth of material as do similar radius crushing surfaces. The energy consumed by the plowing effect is lost and not directed to actual crushing. The new design reduces this energy loss and allows material to enter the crushing zone with less resistance. This consumes less of the available rotating table power and is, therefore, more efficient.

BRIEF DESCRIPTION OF THE DRAWINGS

The above brief description, as well as further objects, features and advantages of the present invention will be more fully appreciated by reference to the following detailed description of the presently preferred, but nonetheless illustrative, embodiment in accordance with the present invention, when taken in conjunction with the accompanying drawings, wherein.

DETAILED DESCRIPTION OF THE PREFERRED EMBODIMENT

Figure 1:
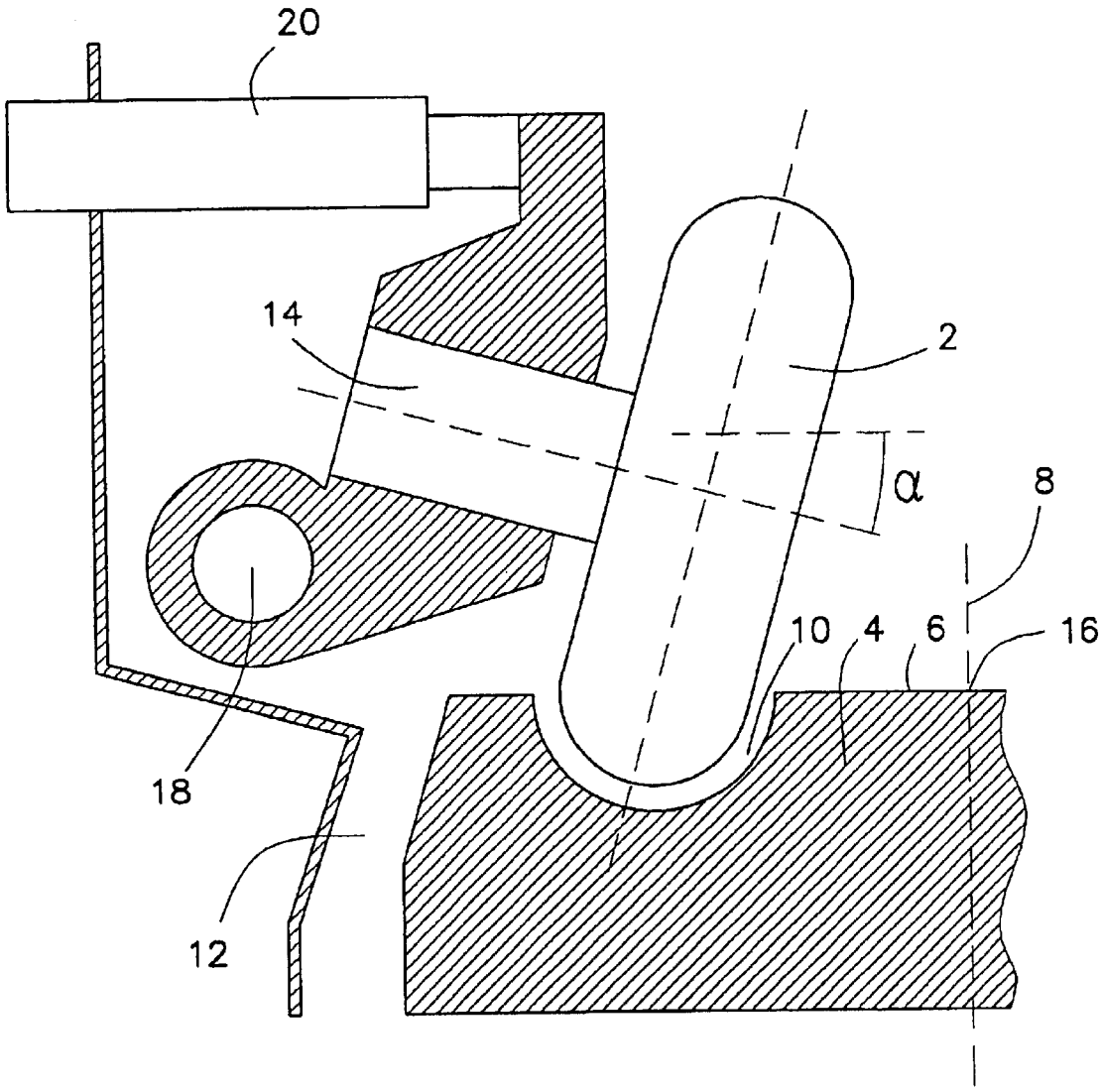
Fig.1 PRIOR ART
FIG. 1 is a schematic, partly sectional view showing a roller and a pulverizing table of a conventional roller mill having arcuate pulverizing surface profiles.

FIG. 1 shows schematically the parts of a conventional roller mill essential for understanding the present invention. A more complete description of the structure and operation of vertical roller mills can be found, e.g., in the prior art publications referred to in the background section of the subject application.

In a roller mill, coal or other hard raw material is introduced to the center portion of the top surface 6 in a pulverizing table 4 made of wear-resistant material. The pulverizing table 4, supported against a base (not shown), is arranged to be rotated around a vertical axis 8. The top surface 6 is generally horizontal with the exception of an annular groove 10 formed therein adjacent to its outer periphery.

At least one roller shaft 14 is mounted on the base in proximity to the pulverizing table 4 at an angle $\alpha$ with respect to the horizontal direction toward a center point 16 of the table. A roller 2 is supported rotatably against the end portion of the shaft 14 above the table 4. The roller 2 is supported by elements comprising a pivoting axis 18 and pressing means 20, i.e., a spring or a hydraulic mechanism allowing the vertical movement of the roller and pressing the roller toward the annular groove 10 by a controlled force.

The raw material is moved radially outward to the annular groove 10 on the pulverizing table 4 by a centrifugal force. The roller 2, or usually several rollers, descend into the groove 10 to pulverize the raw material. After having passed radially through the groove 10, the pulverized material continues towards an air port 12, where it is blown up for further processing. Usually coal mills comprise a coal classifier, not shown in FIG. 1, from where the fine fraction of the coal is discharged from the system and the coarse fraction is reintroduced to the pulverizing table 4.

Figure 2:
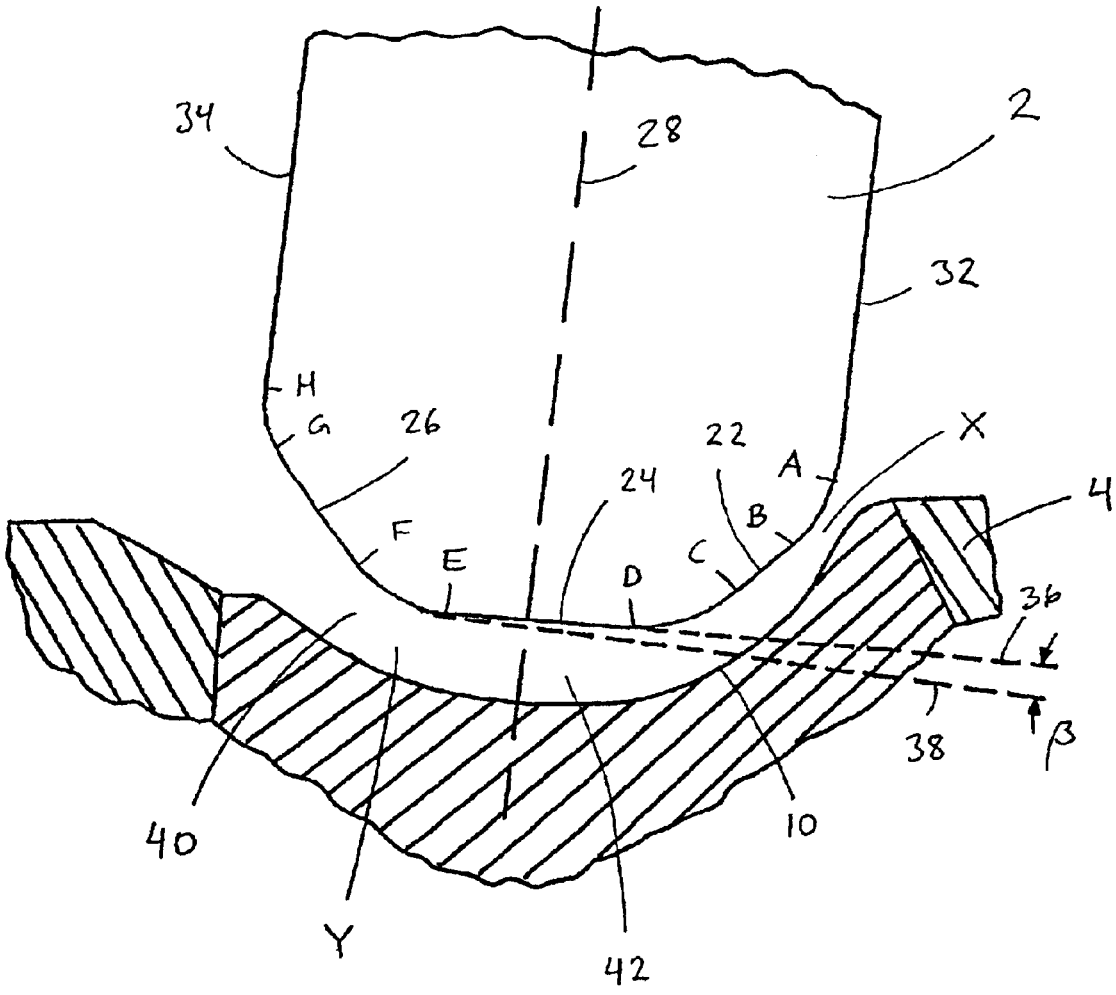
FIG. 2 is a schematic, partly cross-sectional view of the pulverizing surfaces of a roller and the groove provided in a pulverizing table according to a preferred embodiment of the present invention.

FIG. 2 depicts schematically the cross-sectional profiles of the pulverizing surfaces of a roller 2 and a groove 10 provided in a pulverizing table 4 according to a preferred embodiment of the present invention.

The cross-sectional profile of the pulverizing surface of the roller 2 is generally arcuate, but has a flat section 24 in its central portion. Thus, the profile consists of a leading area 22 between points A and D, a main flat section 24 between points D and E, and a trailing area 26 between points E and H. According to the preferred embodiment of the present invention, shown in FIG. 2, the leading area 22 consists of two arcs between points A and B and C and D, respectively, and a tangential section between these arcs, i.e., between points B and C. Correspondingly, the trailing area 26 consists of two arcs between points E and F and G and H, respectively, and a tangential section between these arcs, i.e., between points F and G.

The flat section 24 is located on both sides of the central plane 28 of the roller. The central plane 28 is perpendicular to the roller axis, and at the same distance from the inner and outer faces, 32 and 34, respectively, of the roller. According to a preferred embodiment of the present invention, the flat section 24 is somewhat shifted from the central plane 28 toward the inner face 32 of the roller. Thus, the flat section 24 comprises an inner portion, i.e., a portion spaced from the central plane 28 toward the center of the pulverizing table, and an outer portion, spaced accordingly toward the peripheral portion of the table. The width $W_1$ of the inner portion is typically somewhat larger than the width $W_2$ of the outer portion. The ratio $W_1/W_2$ is preferably between about 1.2 and about 3.

The direction 36 of the flat section 24 of the cross-sectional profile is preferably not parallel with the normal 38 of the central plane 28, i.e., with the axis of the roller 2, but forms an angle β, preferably between about 2° and about 6°, with the normal 38.

The tangential sections between the central flat section 24 and the inner and outer faces, 32 and 34, respectively, of the roller, i.e., between points B and C and points F and G, respectively, are preferably located at an angle of between about 30° and about 50°, most preferably about 40°, with respect to the extensions of the corresponding faces of the roller.

The cross-sectional shape of the annular groove 10 is generally arcuate. However, when using a roller having a profile according to the present invention, it has turned out to be advantageous for the grinding efficiency, if the radius of curvature of the cross section is somewhat smaller in the portion closer to the center of the table 4 than in the outer portion. Thus, according to the preferred embodiment of the present invention, the cross-sectional profile of the groove 10 is formed of two circular arcs having radii of curvature $r_1$ and $r_2$ in the radially inner and outer portions, respectively, whereby the first radius of curvature $r_1$ is smaller than the second radius of curvature $r_2$. Preferably, the arcs with different radii of curvature join each other smoothly around the lowest point of the groove 10.

Between the pulverizing surfaces of the roller 2 and the groove 10 is formed a gap 40 of a nearly constant height. The height is controlled by the pressing means 20, depending on the amount of coal in the system. Due to the well-matched pulverizing surfaces, the load of the roller is distributed evenly over a large area resulting in low and uniform wear of the roller 2 and the groove 10. Due to the smooth shapes of the pulverizing surfaces, the transfer of material through the gap 40 is stable, and thus, the risks of harmful vibrations and overload of the roller mill are minimized.

It has, however, turned out to be important, that the height of the gap 40 is not entirely constant, but the gap 40 has preferably at least two minimum points, X and Y. The first minimum point X is located on the radially inner side of the main flat section 24, usually near the point B or C in FIG. 2. The second minimum point Y is located on the radially outer side of the main flat section 24, typically near the point E.

Between the minimum points X and Y is formed a central void 42, where the gap 40 is somewhat higher than in its surroundings. The central void 42 slows down the flow rate of the material passing through the gap 40 between the pulverizing surfaces. Thus, the material remains therein for a sufficient time to be pulverized effectively. At the first minimum point X the largest particles are crushed. The second minimum point Y prevents the coal from escaping too early from the void 42 toward an air port 12.

While the invention has been herein described by way of an example in connection with what is at present considered to be the most preferred embodiment, it is to be understood that the invention is not limited to the disclosed embodiment, but is intended to cover various combinations or modifications of its features and several other applications included within the scope of the invention as defined in the appended claims.

I claim:

1. A roller mill, comprising:

a base;

a pulverizing table having a substantially horizontal upper surface, supported against said base and arranged to be rotated around a vertical axis intersecting the upper surface in a center point thereof;

an annular groove, formed on the upper surface of said pulverizing table, adjacent to an outer periphery of said table;

at least one roller shaft mounted pivotably on said base in proximity to said table, at an angle α with respect to horizontal direction, toward the center point and having an end portion located above said table;

a pulverizing roller supported rotatably against the end portion of said at least one roller shaft; and means for pressing said pulverizing roller toward said annular groove, wherein raw material introduced to said rotatable pulverizing table is pulverized by compression between said annular groove and said at least one pulverizing roller, wherein said pulverizing roller is manufactured such that, when said pulverizing roller initially is installed in the roller mill, and prior to said pulverizing roller being used to pulverize the raw material, said pulverizing roller has an outer peripheral pulverizing surface, which includes a substantially flat section located in the central portion thereof and at least one arcuate section continuous with the flat section.

2. A roller mill according to claim 1, wherein the width of the substantially flat section is between about 20% and about 60% of the axial width of said roller.

3. A roller mill according to claim 2, wherein the width of the substantially flat section is between about 25% and about 40% of the axial width of said roller.

4. A roller mill according to claim 1, wherein the substantially flat section extends for a distance $W_1$ from a central plane perpendicular to an axis of said roller toward the center of the pulverizing plate, and for a distance $W_2$ from the central plane perpendicular to the axis of said roller toward an outer edge of the pulverizing plate, whereby $W_1$ is larger than $W_2$.

5. A roller mill according to claim 1, wherein the substantially flat section is slanted from the direction of the roller axis at an angle of between 0° and α toward the horizontal direction.

6. A roller mill according to claim 5, wherein the substantially flat section is slanted from the direction of the roller axis at an angle of between about 2° and about 6° toward the horizontal direction.

7. A roller mill according to claim 1, wherein a cross section of the outer peripheral surface of said roller comprises a first tangential section between the substantially flat section and an inner axial face of said roller and a second tangential section between the substantially flat section and an outer axial face of said roller.

8. A roller mill according to claim 7, wherein the first tangential section forms an angle of between about 30° and about 50° with the inner axial face and the second tangential section forms an angle of between about 30° and about 50° with the outer axial face.

9. A roller mill according to claim 1, wherein said groove has an arcuate cross-sectional profile.

10. A roller mill according to claim 9, wherein the cross-sectional profile of said groove has a first radius of curvature in a radially inner portion of said groove and a second radius of curvature in a radially outer portion of said groove, whereby the first radius of curvature is smaller than the second radius of curvature.

11. A roller mill according to claim 1, wherein said at least one pulverizing roller and said groove form a gap having a cross-sectional shape with a minimum height in a radially inner portion of said groove.

12. A roller mill according to claim 11, wherein the cross-sectional shape of the gap has a local minimum in a radially outer portion of said groove.

13. A roller mill according to claim 1, wherein the flat section and the at least one arcuate section have a smooth transition therebetween.

* * * * *